United States Patent [19]

Merrick et al.

[11] Patent Number: 4,917,523

[45] Date of Patent: Apr. 17, 1990

[54] CARD FILE MOUNTING MEMBER

[75] Inventors: Robert G. Merrick; John P. Merrick, both of Cupertino, Calif.

[73] Assignee: Merrick Industries, Inc., Sunnyvale, Calif.

[21] Appl. No.: 234,454

[22] Filed: Aug. 19, 1988

Related U.S. Application Data

[60] Division of Ser. No. 225,638, Jul. 27, 1988, abandoned, which is a continuation-in-part of Ser. No. 623,799, Jun. 22, 1984, abandoned.

[51] Int. Cl.[4] ..... B42F 13/00

[52] U.S. Cl. ..... 402/79; 40/360; 283/54; 283/81; 402/500

[58] Field of Search ..... 40/359, 360; 281/15 B, 281/38; 283/54, 56, 81; 402/79, 500; 312/184

[56] References Cited

U.S. PATENT DOCUMENTS

| | | | |
|---|---|---|---|
| 1,769,395 | 1/1930 | Selden | 402/79 |
| 2,962,335 | 11/1960 | Benson | 312/184 |
| 3,930,700 | 6/1976 | Figueres | 283/54 X |
| 3,970,397 | 7/1976 | Armstrong | 402/79 |
| 4,430,015 | 7/1984 | Nerlinger | 402/79 |
| 4,561,794 | 12/1985 | Smallwood | 402/500 X |

*Primary Examiner*—Paul A. Bell

*Attorney, Agent, or Firm*—Skjerven, Morrill, MacPherson, Franklin & Friel

[57] ABSTRACT

A pocket size punch mechanism is provided to punch openings in cards or card-like objects, the punched openings have a cross-sectional configuration and spacing matching the configuration and spacing of a pair of rails in a commonly available card file. Also shown is mounting structure for adapting cards and card-like objects for mounting in the same type of two rail card file. A plurality of mounting members of a stiff stock material are fabricated on a sheet, the mounting members being individually removable from the sheet as needed to form a member having openings conforming to the configuration of the card file rails. A portion of the mounting member has adhesive thereon to secure to the back of the item to be mounted.

6 Claims, 3 Drawing Sheets

CARD FILE MOUNTING MEMBER

CROSS-REFERENCE TO REELATED APPLICATIONS

This application is a division of co-pending application Ser. No. 07/225,638 filed July 27, 1988, now abandoned which in turn is a continuation of co-pending application Ser. No. 06/743,559 filed June 11, 1985, now abandoned, which in turn is a continuation-in-part of application Ser. No. 06/623,799, filed June 22, 1984, now abandoned.

BACKGROUND OF THE INVENTION

1. Field of the Invention

This invention relates to the mounting of items in a card file which may be randomly accessed by a human, and relates more particularly to structures which facilitate the mounting of a variety of card-like objects, including business cards, in such a file.

2. Description of the Prior Art

A common index card filing system has been used by business people worldwide since the 1930's and before.

The principal feature of this system is a pair of identically shaped rails spaced typically 1" or 1.5" apart which secure cards which are appropriately slotted with T-shaped cutouts or other configurations. The cards snap onto the rails in such a fashion that they can be flipped back and forth quite visibly as one examines the deck looking for a particular card. Another feature of the system is the fact that the cards are easily attached and removed for rearrangement. This card filing system takes a variety of forms. Thus wheels, covered wheels, racks, covered racks, mini-trays, etc., are offered to house lists, cards, snapshots and other objects, so long as these objects present the necessary shaped slots to complement the shape of the two rails.

Recognizing the continuing popularity of such card file structure, inventors have created numerous product configurations over the years which rely on these rails to hold the cards into a freely accessible and easily rearrangeable file deck. The manufacturers of these files, such as Rolodex Corporation of Secaucus, New Jersey, Eldon Industries, Inc., of Hawthorne, California, and others, usually offer plain white cards, appropriately slotted, onto which information may be typed or handwritten. Very often people use a scissors to trim a business card to smaller dimensions so it will fit onto these cards and attach the business card to the plain white card by means of cellophane tape or staples. Other manufacturers offer clear vinyl envelopes or cases which are appropriately slotted, into which may be inserted file cards, business cards, snapshots and the like, which then may be attached to the dual rails. The drawback of this approach is that the vinyl envelopes are relatively expensive and it is somewhat time consuming to insert the cards into the cases. Further, the cases themselves add to the thickness of each entry, thereby reducing the capacity of the file.

U.S Pat. No. 3,970,397 "Business Card System", Armstrong, discloses a 4×5 inch card with markings and perforations for selectively removing material from slots to form any one of a number of desired card configurations. That patent pertains to a specially manufactured card, and does not address the problem of modifying the preponderance of existing business cards or other objects to render them receptive to the dual rails.

A company named Matex of Mount Joy, Pennsylvania, markets a product in the form of an individually fabricated and packaged press-on member having openings therein matching the configuration of uniquely spaced rails on a special Matex index file. By applying the member to the back of a business card or the like, the card can be placed in the Matex file. The Matex file is a new system which does not address the possibility of altering cardlike objects to render them attachable to the many existing dual rail files.

Despite the permanent popularity of the dual rail filing system and despite several attempts to solve the problem of using these rails to accommodate business cards and snapshots, there has not yet been introduced a totally workable and attractive solution.

SUMMARY OF THE INVENTION

In view of the above observations concerning a popular filing system, i.e. the dual rail file card type which is greatly under-used for the filing of business cards and snapshots, the present invention provides quick, easy and inexpensive ways to physically modify business cards and snapshots so as to make them directly attachable to ordinary dual rails for convenient filing. The invention relates to two products which provide methods of physically modifying business cards, snapshots and other card-like objects so as to adapt them to the dual rail products which are ubiquitous in the business world.

The first product is an inexpensive punching or slotting tool which can be used to cut away slots spaced a selected distance apart, for example 1" or 1.5" apart, in business cards, snapshots and other card-like objects. The tool is light duty in that it is designed to punch the thickness of only one paper index or business card at a time.

The second product is a thick paper label with adhesive back which is designed to be a rigid tab, creating two identical slots matching the common dual rail configuration of the index card system and having an adhesive strip for attachment to the back of the object to be mounted.

DESCRIPTION OF THE PREFERRED EMBODIMENT

The punching or slotting tool of the present invention is a relatively inexpensive pocketsize device, preferably made of a hard plastic material, such as fiberglass reinforced nylon ®, which is designed to cut the appropriate dual slots into at least a selected number of business cards (for example, 1,000 or more business cards), one at a time, without showing appreciable wear. In addition to being low cost and portable, it permits the user to look through the die holes to see what information, if any, is subject to being cut away prior to cutting. This feature gives the user the option of adjusting away from needed information and/or to transcribe such data elsewhere on the card prior to punching. Even if these adjustments and transcriptions are made, the time required is still less than any other existing method for filing business cards and the like.

Figure 1:
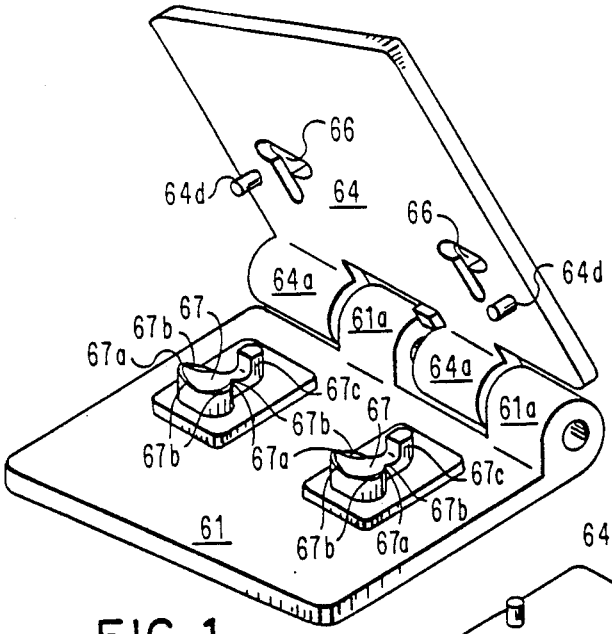
FIG. 1 is a perspective view of the preferred embodiment of the present invention.

Referring to the perspective view of FIG. 1, the punching tool includes a hinged punch plate member 61 having cutting or punching teeth 67 which engage openings 66 in a complementary die plate member 64. Openings 66 have a configuration corresponding to that of the crosssection of the rails in the index system with which the punched item is to be used. In the drawing, openings 66 are shown of "T" configuration for use in the most commonly available index system.

Each of punching teeth 67 has two sharp peak-like toothed portions 67*a* in approximately the middle thereof to facilitate penetration of the business card upon contact therewith. On either side of portions 67*a* and contiguous therewith the punching teeth have a wider cutting edge portion 67*b*, this widened portion providing increased cutting surface to increase the wear life of the punching teeth while still accomplishing cutting after the initial penetration by portions 67*a*. The punching teeth portion of the punch mechanism also includes raised stop members 67*c* which serve to register the bottom edge of an inserted card or other object for proper punching positioning, as will be described in more detail below in connection with FIG. 4.

Figure 2:
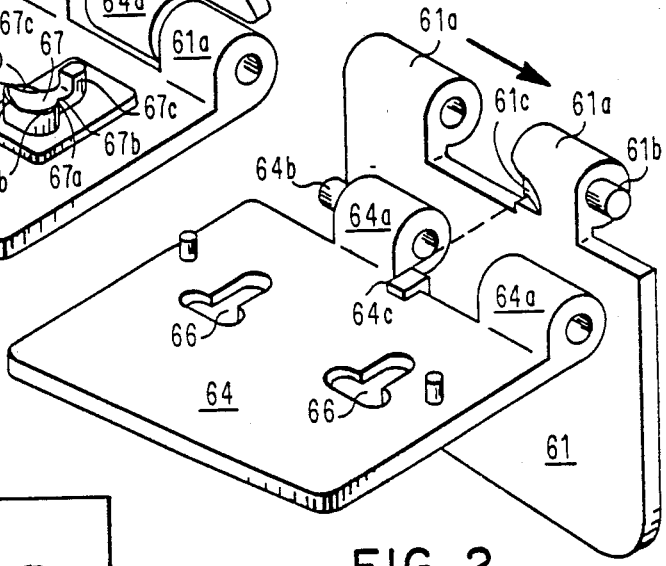
FIG. 2 is an exploded perspective view of the device in FIG. 1 showing the two punch members in their most separated position to illustrate the portion of the structure which insures locking together of the members.

Members 61 and 64 are preferably molded of a suitable plastic material. As best seen in FIG. 2, parts 61 and 64 are preferably formed in a hinged configuration with cylindrical portions 61*a* and 64*a*, each of these portions having an extending pin portion 61*b* and 64*b* which is adapted to engage a mating opening in the corresponding cylindrical portions of 64*a* and 61*a* of the other member for assembly of the punch mechanism without requiring the use of a separate pin component for hinging. Thus, the present invention provides a novel hinged mechanism which, independently of the function performed by members 61, 64, can be fabricated using only the two components 61, 64.

Figure 3:
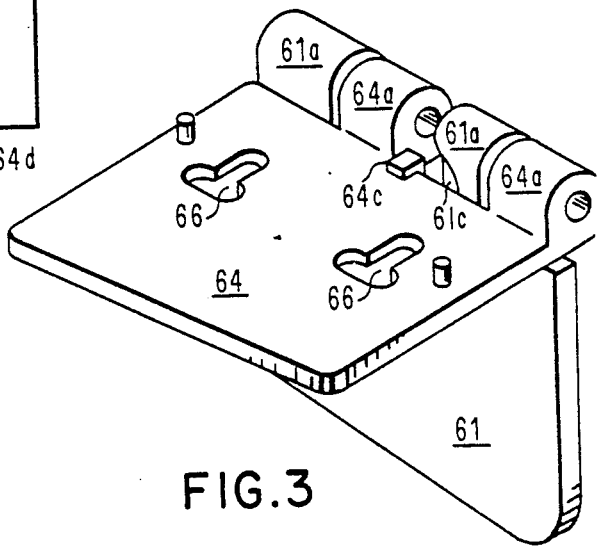
FIG. 3 is a perspective view showing how the punch members engage each other to lock together.

In accordance with an important feature of the invention, the punch member is constructed in a manner which insures a stable mechanical relationship between the two parts of the punch. As shown in FIG. 2, member 64 is provided with a raised lug member 64*c* at the rear thereof adjacent one of the cylindrical portions 64*a*. Lug 64*c* is adapted to engage a cam slot or grooved portion 61*c* in the one cylindrical portion 61*a* of member 61. This engagement occurs only when members 61 and 64 are in the relative position shown in FIG. 2; that is, when the members 61, 64 are disposed at right angles to each other for assembly of the two members. While maintaining this perpendicular relationship, members 61, 64 may be moved toward each other, with pins 61*b*, 64*b* passing through or clearing the spaces between cylindrical portions 61*a*, 64*a*. When pins 61*b*, 64*b* are axially aligned with the corresponding openings in cylindrical portions 64*a*, 61*a*, lug 64*c* will be disposed in slot portion 61*c*. Then, by providing relative lateral movement between members 61, 64 (moving member 64 to the left in the drawing or moving member 61 to the right), pins 61*b*, 64*b* will enter the corresponding openings in cylindrical portions 64*a*, 61*a* while lug 64*c* slides laterally in slot 61*c* as shown in FIG. 3. The engagement between pins 61*b*, 64*b* and the openings in portions 64*a*, 61*a* is preferably of a semipress fit type to insure firm snap-on locking engagement of members 61, 64 while still permitting disassembly of the mechanism if required.

After assembly, members 61, 64 are rotated toward each other on the axis formed by pins 61*b*, 64*b* and cylindrical portions 64*a*, 61*a*. When members 61, 64 are rotated slightly from the position shown in FIG. 3, lug 64*c* leaves slot 61*c* and bears against or is positioned closely adjacent to the left edge of the cylindrical portion 61*a*. This relationship between lug 67*c* and portion 61*a* prevents any lateral movement between members 61, 64, to thereby prevent inadvertent disassembly of the punch mechanism. To disassemble the punch, members 61, 64 are returned to the position shown in FIG. 3, and relative movement between members 61, 64 is provided in the direction opposite to that employed for assembly. With this movement, lug 67*c* slides laterally in groove 61*c* and pins 61*b*, 64*b* can be withdrawn from cylindrical portions 64*a*, 61*a*, against the snap-on lock fit described above for assembly, permitting separation of members 61, 64.

As members 61, 64 approach each other after assembly, the rounded rear surfaces of portions 67*c* enter the rounded portions at the rear of openings 66 in die member 64. This interaction is an important feature in ensuring proper axial alignment between punching teeth 67 and openings 66 and serves to provide a precise final alignment to supplement the coarse alignment initially provided by lug 64*c* and slot 61*c*.

Figure 4:
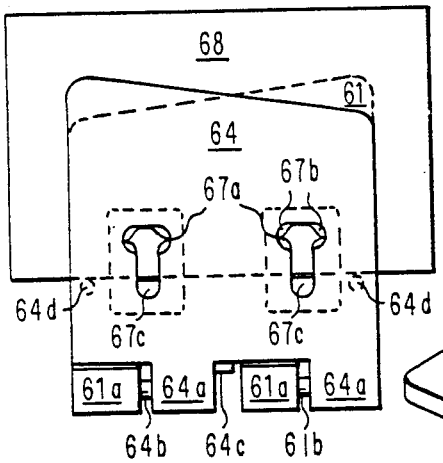
FIG. 4 is a plan view illustrating the placement of a business card in the punch of this invention after completion of punching.

The punching operation is best illustrated in FIG. 4 where an object 68, such as a business card, is shown inserted in the punch between members 61, 64. When fully inserted, card 68 is properly registered for punching when its bottom edge bears against raised stop members 67*c* on punching teeth 67. Proper registration is facilitated by registration pins 64*d* on member 64 (FIGS. 1 and 4) which are axially aligned with the registration faces of stop members 67*c*, as best seen in FIG. 4, to provide additional support to align card 68 for proper punching.

The slots cut by the present tool have a lesser vertical dimension than prior art slots which result in the cards being elevated to a higher profile in the deck, providing better visibility compared to cards which might be punched with the standard size slots. This lesser vertical dimension also results in the cards resting on the top surfaces of the rails instead of the base surface of the rack as in the prior art.

The present punch is designed to punch slots which are at least 28% smaller in area than those slots generally used in such applications. This feature lessens the tasks of the cutting edges of the tool which are preferably made of plastic. This feature also lessens the chance by at least 28% that useful information will be cut away. Finally, this feature results in a handactuated tool which can be operated easily by everyone (the smaller slots require less force to cut), especially persons who for whatever reason have reduced strength in their hands.

The extreme edges of the punch and die plates of the tool are biased oppositely, as seen in FIG. 4, to provide thumb and finger tabs useful in opening the hinge-like device should it jam closed. The advantage of this product is to perform in a single step the correct modification to a business card, snapshot or other object which makes it immediately and directly attachable onto the common two rail rack or wheel index card files.

Figure 5:
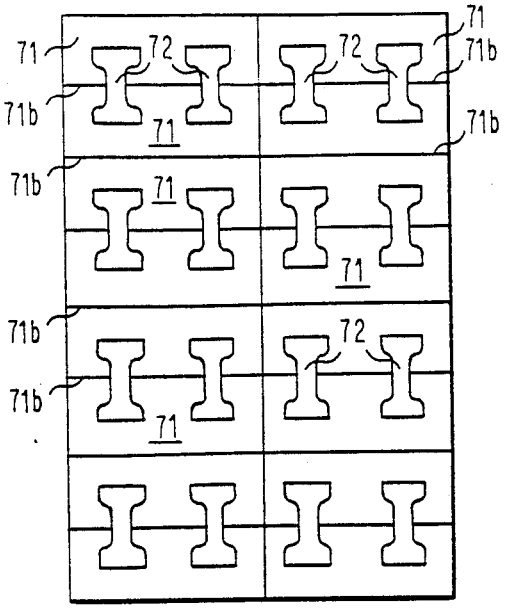
FIG. 5 illustrates one side of a sheet containing a number of the rigid tab members to be used for mounting an object in a card file.
Figure 6:
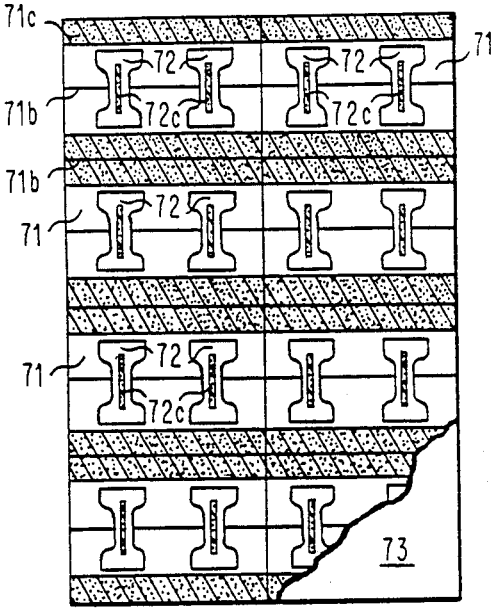
FIG. 6 shows the other side of the sheet of FIG. 5 illustrating the application of adhesive to selected portions of that side.

FIGS. 5 and 6 illustrate a novel structure and method for producing mounting members for application to a business card or like object to facilitate placing the object in a card file of the type discussed above. As shown in FIG. 5, the mounting members are formed from a sheet of heavy or firm stock such as the type of stock from which conventional business cards are made. The sheet is precut, such as by die cutting or the like, to form a plurality of mounting members 71 which may be removed from the cut stock sheet along the cut lines **71*b* for application to an object to be mounted. Adjacent pairs of members 71 share a pair of generally dumbell-shaped cut portions 72 which, when removed, leave a pair of openings 71*a* in each mounting member 71, as will be described below in connection with FIG. 7**.

Figure 8:
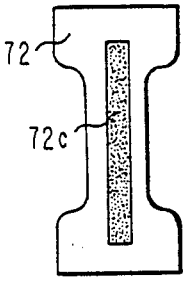
FIG. 8 illustrates one of the die cut members whose removal from the facing mounting members in the sheet of FIG. 5 creates openings in adjacent mounting members.

FIG. 6 shows the reverse side of the stock sheet of FIG. 5, illustrating the cut lines **71*b* and the removable portions 72. Selected portions of the surfaces of members 71 shown in FIG. 6 have applied thereto an adhesive layer 71*c* for securing the mounting member to an object to be mounted. Adhesive layer 71*c* is preferably transparent to permit viewing of printed material such as printed instructions appearing on mounting member 71. Adhesive layer 71*c* can be selectively applied by means of known printing techniques, after which a removable release liner layer 73 is applied to the adhesive to protect it until ready for use. Preferably, a small amount of adhesive 72*c* is also applied to dumbell-shaped members 72 (FIG. 8) at the time of applications of adhesive 71*c*. Adhesive 72*c* causes members 72 to adhere to release liner 73 after removal of the associated mounting members 71, thereby eliminating any problem of disposition of members 72** during manufacture and until after they have served their purpose.

Figure 7:
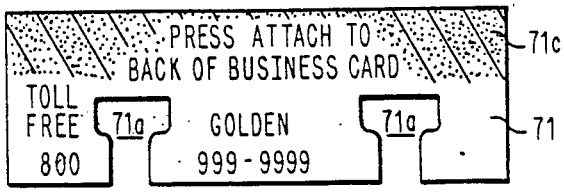
FIG. 7 shows the adhesive-containing side of one of the mounting members.
Figure 9:
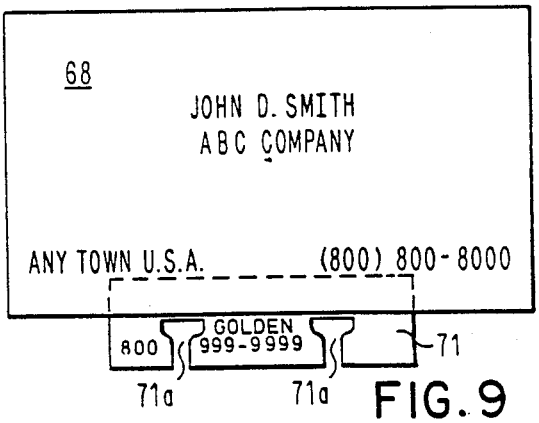
FIG. 9 illustrates the application of a mounting member of the present invention to a representative business card.
Figure 10:
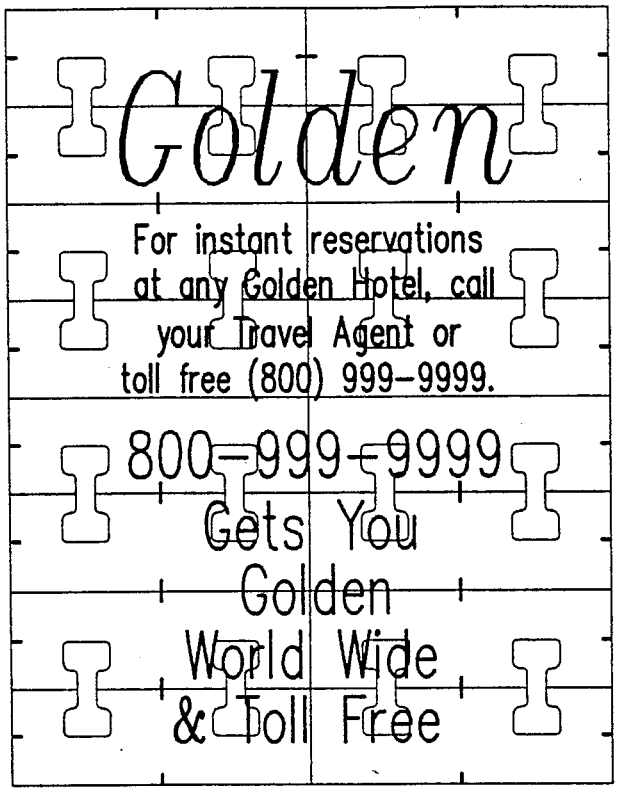
FIG. 10 illustrates the application of advertising messages to the face of the sheet shown in FIG. 5.

To use a mounting member 71, it is peeled from the sheet, separating therefrom on the cut lines **71*b* and leaving portion 72 adhering to release liner 73. This results in a structure as shown in FIG. 7, with a pair of openings 71*a* adapted to fit on the rail of a card file system. Member 71 is applied to the back of a business card or the like, with adhesive portion 71*c* forming a bond to the back of the card to produce a structure as shown in FIG. 9 for mounting in a card file. As shown in FIG. 9, the bottom portion of mounting member 71 may contain advertising or other message which will remain visible to a user after the object is mounted in a card file. Additionally, the front of the sheet shown in FIG. 5 may have applied thereto an advertising message which is intelligible despite the cut lines 71*b* and which will remain effective until the removal and use of the majority of the mounting members on the sheet as shown in FIG. 10**.

We claim:

1. Structure for producing a plurality of mounting members for application to an object to be mounted on a pair of rails of a card file index, said structure comprising:

a sheet of rigid stock material, said sheet being precut into a plurality of separable ones of said mounting members which are disposed adjacent each other on said sheet, pairs of adjacent ones of said mounting members having openings preformed therein along their facing edges, a backing sheet;

an adhesive material applied to selected portions of one side of said mounting members to adhere said members to said backing sheet until use, said adhesive material serving to attach said mounting member to an object after removal of said mounting member from said backing sheet.

2. Structure in accordance with claim 1 in which the portion of said sheet which is pre-cut to form said openings in said facing edges of adjacent pairs of said mounting members has adhesive material applied thereto to adhere said portion to said backing sheet upon removal of one of said mounting members from said backing sheet.

3. Structure in accordance with claim 1 in which the lower portion of said mounting member bears written or graphic material which is visible after attachment of said mounting member to an object to be mounted.

4. Structure in accordance with claim 1 in which the outer surface of said sheet of stock material contains written and/or graphic material which is intelligible until some of said mounting members having been removed therefrom.

5. Structure in accordance with claim 1 in which said adhesive material is transparent.

6. Structure in accordance with claim 1 in which the portion of said sheet which is precut to form said openings in said facing edges of adjacent pairs of said mounting members is symmetrical with respect to said adjacent pairs.

* * * * *

UNITED STATES PATENT AND TRADEMARK OFFICE

CERTIFICATE OF CORRECTION

PATENT NO. : 4,917,523

DATED : April 17, 1990

INVENTOR(S) : Robert G. Merrick et al.

It is certified that error appears in the above-identified patent and that said Letters Patent is hereby corrected as shown below:

On the title page, item [60]

RELATED U.S. APPLICATION DATA

"Division of Ser. No. 225,638, Jul. 27, 1988, abandoned, which is a continuation-in-part of Ser. No. 623,799, Jun. 22, 1984, abandoned." should read --Division of Ser. No. 225,638, Jul. 27, 1988, which is a continuation of Ser. No. 06/743,559, June 11, 1985, abandoned, which is a continuation-in-part of Ser. No. 623,799, Jun. 22, 1984, abandoned.--

Col. 1, line 4, "REELATED" should read --RELATED--.

UNITED STATES PATENT AND TRADEMARK OFFICE

CERTIFICATE OF CORRECTION

PATENT NO. : 4,917,523

DATED : April 17, 1990

INVENTOR(S) : Robert G. Merrick, et al

It is certified that error appears in the above-identified patent and that said Letters Patent is hereby corrected as shown below:

Col. 1, lines 6-12 should read --This application is a division of co-pending application Ser. No. 07/225,638 filed July 27, 1988, which in turn is a continuation of co-pending application Ser. No. 06/743,559 filed June 11, 1985, now abandoned, which in turn is a continuation-in-part of application Ser. No. 06/623,799, filed June 22, 1984, now abandoned.--

Signed and Sealed this

Twenty-seventh Day of August, 1991

*Attest:*

*Attesting Officer*

HARRY F. MANBECK, JR.

*Commissioner of Patents and Trademarks*